United States Patent [19]

Salavin et al.

[11] Patent Number: 5,066,890

[45] Date of Patent: Nov. 19, 1991

[54] PLASMA PANELS IN DELIMITED DISCHARGE ZONES

[75] Inventors: Serge Salavin, St Egreve; Jacques Deschamps, Grenoble; Michel Gay, Le Fontanil; Michel Specty, Echirolles, all of France

[73] Assignee: Thomson Tubes Electroniques, Boulogne Billancourt, France

[21] Appl. No.: 542,592

[22] Filed: Jun. 25, 1990

[30] Foreign Application Priority Data

Jun. 23, 1989 [FR] France ..... 89 08386

[51] Int. Cl.[5] ..... H01J 17/49

[52] U.S. Cl. ..... 313/585; 313/584

[58] Field of Search ..... 313/584, 585, 586, 517, 313/518, 521; 315/169.4; 340/758, 769, 771

[56] References Cited

U.S. PATENT DOCUMENTS 3,975,725 8/1976 Ogle ..... 340/324 M 4,190,788 2/1980 Yoshikawa et al. ..... 315/169.4

FOREIGN PATENT DOCUMENTS 0135382 3/1985 European Pat. Off. .

59-79937 5/1984 Japan .

*Primary Examiner*—Leo H. Boudreau

*Assistant Examiner*—Steven P. Klocinski

*Attorney, Agent, or Firm*—Oblon, Spivak, McClelland, Maier & Neustadt

[57] ABSTRACT

A coplanar sustaining plasma panel, and particularly an electrode arrangement make is possible to better contain the sustaining discharges in a predetermined zone. Plasma panel (10) of the invention comprises addressing electrodes (X1 to X3) crossed with sustaining electrodes arranged by pair (p1, p2), each sustaining electrode pair being formed of an addressing-sustaining electrode (Y1, Y2) and a sustaining-only electrode (E1, E2). A pixel (PX1 to PX6) consists approximately at each crossing of an addressing electrode (X1, X2, X3) with a sustaining electrode pair (p1, p2). At least one of two electrodes (Y1, E1) of same pair (p1) comprises, at the level of each pixel (PX1 to PX6), a projecting surface (SB1 to SB3, SC1, SC3) oriented toward the other electrode. According to a characteristic of the invention, projecting surfaces (SB1 to SB3, SC1 to SC3) are arranged so that between two consecutive pixels (PX1 to PX6) of same pair (p1, p2), of the two closest projecting surfaces, one belongs to an addressing-sustaining electrode (Y1, Y2) and the other to a sustaining-only electrode (E1, E2).

2 Claims, 3 Drawing Sheets

PLASMA PANELS IN DELIMITED DISCHARGE ZONES

BACKGROUND OF THE INVENTION

1. Field of the invention

The invention relates to the plasma panels of coplanar sustaining type, and it particularly relates to means for containing, in predetermined zones, the discharges in the gas.

2. Discussion of the Background

Plasma panels are flat screen display devices, now well known, which make possible the display of alphanumeric, graphic or other images, either in color or black and white. Generally, the plasma panels include two insulating plates limiting a space occupied by a gas (generally a mixture with a neon base). These plates support conductive electrodes arranged in columns and in lines, so as to be crossed and to define a cell matrix, each cell forming an image surface element or pixel (one cell being approximately the gaseous space between two crossed electrodes). The operating principle is the selective generation (at the intersection of electrodes in a line and electrodes in a column, i.e. at the level of the pixels selected) of electric discharges in the gas. The display of the data is assured by a light emission which accompanies these discharges.

Some plasma panels operate continuously, but most often it is preferred to use panels of the so-called "alternating" type, whose operation is based on an excitation under alternating conditions of the electrodes. In this case, the electrodes are covered by a dielectric material layer, and they are no longer in direct contact with the gas or with the discharge. One of the advantages of this plasma panel type called "alternating" is to offer a memory effect which makes it possible to address the useful data only to the pixels whose state (lit or extinguished) it is desired to change. For the other pixels, their state is maintained simply by repetition of alternate electric discharges, called maintenance discharges, discharges which are obtained only at the level of the pixels which are in the lit state.

Of the plasma panels of alternating type, some use only two electrodes to define a pixel: an electrode arranged in columns called a column electrode which is crossed with an electrode arranged in a line called a line electrode. These two electrodes assure both the addressing functions and the sustaining functions.

In order to particularly improve the luminance of the plasma panels and also to make possible the display of several colors, it is preferable to use plasma panels of the energized type under alternating conditions as described above and which further have coplanar sustaining. In this latter plasma panel type called "coplanar sustaining," each pixel of the matrix consists of at least three electrodes, more precisely at the crossing between an addressing electrode with two parallel sustaining electrodes forming a sustaining electrode pair. In this plasma panel type, the sustaining of the discharges, i.e. the repetition of the alternate discharges mentioned previously, is assured between the two sustaining electrodes of the same pair, and the addressing of a given pixel is made by discharge generation between two crossed electrodes of which one is the addressing electrode and of which the other is one of the two electrodes of the sustaining electrode pair. The addressing electrode performs only an addressing function, and it is arranged most often in the direction of the columns.

The sustaining electrodes are parallel and arranged most often in the direction of the lines, and of the two electrodes of the same sustaining electrode pair: one is called addressing-sustaining electrode and it performs an addressing function in cooperation with the addressing electrode, and it performs, on the other hand, a sustaining function in cooperation with the second sustaining electrode of the same pair; the second sustaining electrode is called "only sustaining electrode," and it performs only a sustaining function of discharges.

The operation of a plasma panel of the coplanar sustaining type, with three electrodes per pixel, is known, for example, in European patent document EP-A-0135382.

The coplanar sustaining plasma panels offer many advantages but also raise some difficulties particularly concerning the separation or the limitation of the discharges throughout the electrodes.

To define the sustaining discharge zone better at the level of a pixel, it is known to give the sustaining electrodes a shape such that they each exhibit a protuberance or a projecting surface capable of promoting the discharge: in the same sustaining electrode pair, the projecting surfaces of an electrode are oriented toward those of the other electrode so that, at the level of a pixel, the projecting surfaces of the two electrodes are opposite one another, aligned on the same axis identical or parallel to the axis of the addressing electrode which crosses them, so that the distance between the projecting parts of the two electrodes is smaller than the distance between the electrodes themselves (of the same pair), which tends to delimit the zone of the beginning of the sustaining discharges between the two projecting surfaces. However, it can be difficult to obtain a correct containment of the discharges in the assigned zone, which particularly results in a limitation on the range of operating voltages applied between the two electrodes of the same sustaining electrode pair.

FIG. 1 shows, diagrammatically and partially, a coplanar sustaining plasma panel of the prior art, a panel which is represented mainly by addressing electrodes and sustaining electrodes, and which makes it possible to better understand the problem being presented. Plasma panel 1 of FIG. 1 comprises addressing electrodes X1, X2, arranged in columns, and sustaining electrode pairs p1, p2 arranged in lines. To simplify the figure, only two addressing electrodes X1, X2 and only two sustaining electrode pairs p1, p2 are shown, and consequently only four pixels PX1 to PX4 are shown.

Sustaining electrode pairs p1, p2 each comprise an addressing-sustaining electrode Y1, Y2 and a sustaining-only electrode E1, E2.

Addressing electrodes X1, X2 are perpendicular to sustaining electrode pairs p1, p2, and, in the example shown in FIG. 1, addressing electrodes X1, X2 are shown in a plane having less depth than the plane in which sustaining electrode pairs p1, p2 are arranged. Furthermore, sustaining electrode pairs p1, p2 appear to be seen through addressing electrodes X1, X2 in the part where they are crossed with the latter, and, for more clarity of the figure, addressing electrodes X1, X2 are shown in dotted lines. It should be noted that such an arrangement corresponds to the most common standard structure, in which the discharges in the gas are masked partially by the addressing electrodes or seen through the latter when the latter are transparent.

At the level of each pixel, each of the electrodes of each sustaining electrode pair p1, p2 is provided with a setback or protuberance or projecting surface. These surfaces are referenced SA1, SA2 for addressing-sustaining electrodes Y1, Y2, and referenced SE1, SE2 for the sustaining-only electrodes E1, E2. These projecting surfaces SA1, SA2, SE1, SE2 all are formed in the same manner for each pixel, and by taking, for example, first pixel PX1, formed at the crossing of first addressing electrode X1 and first pair p1, first addressing-sustaining electrode Y1 and first sustaining electrode E1, respectively, these electrodes comprise a projecting surface SA1 and a projecting surface SE1 which are oriented toward one another, opposite and aligned on same axis x1 which constitutes the axis of first addressing electrode X1. A similar arrangement is found at the level of other pixels PX2, PX3, PX4.

As an example, first pixel PX1 has the ends opposite projecting surfaces SA1, SE1 which are, at a distance D, less than the distance which is necessary to trigger a discharge between these two projecting parts SA1, SE1, taking into account potential difference V which is applied to these two projecting surfaces, i.e., which is applied between the two electrodes of each maintenance electrode pair p1, p2.

In operation, after the addressing has been made with a discharge between, for example, first addressing electrode X1 and first addressing-sustaining electrode Y1, assuming that first pixel PX1 has been selected, the alternate sustaining discharges produce the light emitted by pixel PX1.

The electrodes as well as the projecting parts are insulated by dielectric layers, and during a sustaining discharge, electric charges are placed on the dielectric layers and create an internal electric field which is opposed to the electrical field induced between the two electrodes of the same pair, by the voltage pulses of opposite polarity which are applied to the two electrodes of same sustaining electrode pair p1, p2. The internal field created by these charges increases until it brings about the end of the discharge, i.e., the extinguishing of the pixel. But the cell or pixel preserves in memory the internal field previously acquired, and for the following sustaining discharge, this internal field promotes the triggering of the discharge, by being added to the internal electric field, which results from the application to the sustaining electrodes of the sustaining voltage pulses whose polarities are reversed relative to the preceding occurrence. Thus, when the sustaining pulses are applied to the addressing-sustaining electrodes and sustaining-only electrodes which constitute these pairs p1, p2, all addressing-sustaining electrodes Y1, Y2 are brought to a first polarity while sustaining electrodes E1, E2 are brought to the opposite polarity. By assuming that at a given moment when a sustaining discharge is made at the level of first pixel PX1, for example, addressing-sustaining electrodes Y1, Y2 are at a polarity +V, sustaining-only electrodes E1, E2 are brought to opposite polarity −V, and the ionization of the gas creates positive and negative charges referenced by + signs and − signs. Positive charges + are placed mainly on projecting surface SE1, but also on a part of sustaining-only electrode El close to this projecting surface, and negative charges − are fixed mainly on the edges of projecting surface SA1, but also on a part of addressing-sustaining electrode Y1 close to this projecting surface SA1; these positive and negative charges being produced until the end of the discharge.

With the distance D which separates two projecting surfaces SA1, SE1 in a pixel PX1 being less than a distance D1 which separates addressing-sustaining electrode Y1 from sustaining-only electrode E1, the potential difference between these two electrodes determines the equipotential lines referenced a, b, c, which correspond respectively, for example, to +V/2, to zero volt, to −V/2, and which are much closer between the parts opposite projecting surfaces SA1, SE1 than along the electrodes outside of these parts opposite, i.e., for example, in the direction of second projecting surfaces SA2, SE2 of second pixel PX2. As a result, the forces exerted on these positive and negative charges +, − can be insufficient to prevent these charges from extending in the direction of second pixel PX2 during the ionization of the gas.

As a result, for the following sustaining discharge, the polarity of the voltage pulses applied to addressing-sustaining electrodes Y1, Y2 and sustaining-only electrodes E1, E2 are reversed. The charges thus accumulated promote the triggering of the discharge between projecting surfaces SA1, SE1 opposite, belonging to first pixel PX1, but these charges also can promote the creation of discharges along two electrodes Y1 and E1 to project beyond the zone reserved for adjacent pixel PX2.

A solution to this problem of the migration of charges consists in using barriers of insulating material, to insulate the pixels from one another materially. Such a structure is described in an article of G. W. DICK published in PROCEEDINGS OF THE SIDE, Vol. 27/3, 1986, p. 183–187. It should be noted that in the structure described in this document, the sustaining electrodes have a constant width, i.e., they do not comprise a projecting surface opposite in a maintenance electrode pair.

One of the drawbacks of this solution based on the barriers used to contain the sustaining discharge in predetermined zones is that it significantly complicates the production.

It should be noted that another drawback of structures of the type shown in FIG. 1 resides in the fact that the light emitted by a pixel has a greater intensity at the level of the projecting parts opposite than for the remainder of the pixel, and the addressing electrode is arranged exactly in front of this part forming a light source of greater intensity from which a loss of the light output results.

SUMMARY OF THE INVENTION

Accordingly, one object of this invention is to provide a plasma panel having sustaining electrodes provided with projecting surfaces, whose arrangement makes possible both a better containment of the discharges and an increase of the luminance of each pixel. The solution of the invention is simple and inexpensive, and can be applied in the case of all coplanar sustaining plasma panels.

According to the invention, a coplanar sustaining plasma panel comprises addressing electrodes crossed with sustaining electrodes arranged by pair, each sustaining electrode pair being formed of an addressing-sustaining electrode and a sustaining-only electrode, a pixel consisting approximately, at each crossing, of an addressing electrode with a sustaining electrode pair, each sustaining electrode pair defining a pixel line, at least one of the two electrodes of the same pair comprising, at the level of each pixel, a projecting surface oriented toward the other electrode. This display panel is characterized in that the projecting surfaces are arranged so that between two consecutive pixels of the same pair, of the two closest projecting surfaces, one belongs to an addressing-sustaining electrode and the other to a sustaining-only electrode.

BRIEF DESCRIPTION OF THE DRAWINGS

The invention will be understood better from reading the following description, given by way of nonlimiting example with reference to the accompanying figures, of which.

DETAILED DESCRIPTION OF THE INVENTION

Figure 2:
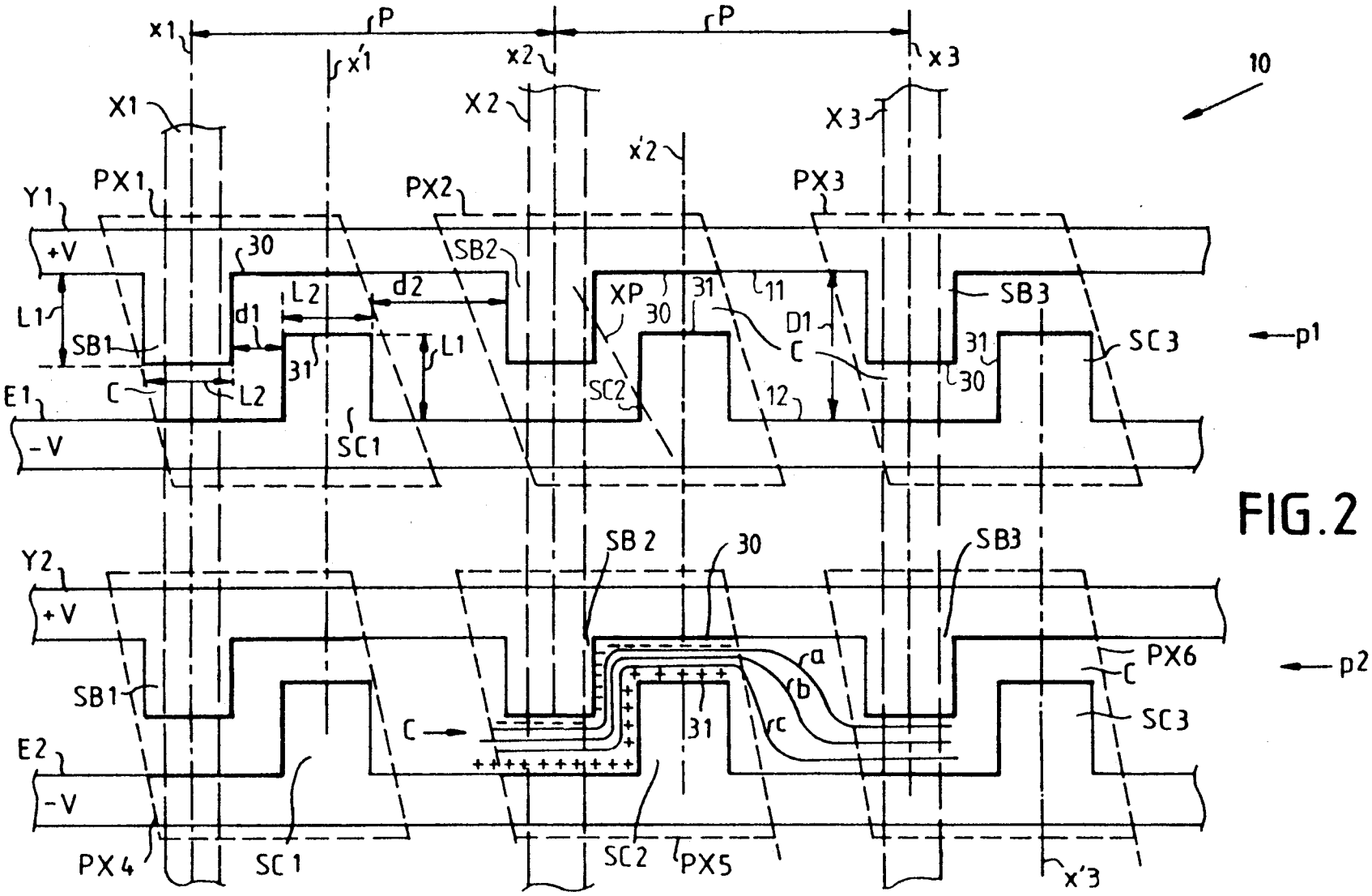
FIG. 2 shows electrodes of a plasma panel according to the invention.

Various other objects, features and attendant advantages of the present invention will be more fully appreciated as the same becomes better understood from the following detailed description when considered in connection with the accompanying drawings in which like reference characters designate like or corresponding parts throughout the several views and wherein FIG. 2 diagrammatically shows electrodes which symbolize a plasma panel 10 according to the invention. Panel 10 is formed of addressing electrodes X1, X2, X3 which perform only an addressing function. Panel 10 further comprises sustaining electrodes which consist, on one hand, of addressing-sustaining electrodes Y1, Y2, and, on the other hand, of so-called sustaining-only electrodes E1, E2. Each addressing-sustaining electrode Y1, Y2, is joined to a sustaining-only electrode E1, E2 so as to constitute a sustaining electrode pair p1, p2. Pairs p1, p2 are parallel to one another and perpendicular to addressing electrodes X1 to X3 and crossed with the latter. A pixel PX1, PX2 .., PX6 is constituted at each crossing of an addressing electrode X1 to X3 with a pair p1, p2. For greater clarity of the figure, only three addressing electrodes Xl, X2, X3 and only two sustaining electrode pairs p1, p2 are shown so that only 6 pixels PX1 to PX6 (delimited by dashes) are formed in FIG. 2.

According to a characteristic of the invention, addressing-sustaining electrodes Y1, Y2 and sustaining-only electrodes E1, E2 comprise projecting surfaces which, in the same pair p1, p2 and in the same pixel PX1 to PX6, are arranged along different axes, crosswise to pairs p1, p2.

As a result, in the same pixel, an addressing electrode X1 to X3 can cross only a projecting surface. Thus, for first pixel PX1 formed at the crossing of first addressing electrode X1 and first pair p1, first addressing-sustaining electrode Y1 is provided with a projecting surface SB1 which is oriented toward sustaining-only electrode E1 of this electrode pair p1; on the other hand, first electrode E1 also is provided with a projecting surface SC1 which is oriented toward first addressing-sustaining electrode Y1.

In the nonlimiting example of the description, first addressing electrode X1 crosses first projecting surface SB1 of electrode Y1, the latter being located along same axis x1 as first addressing electrode X1. Projecting surface SC1 that first sustaining-only electrode E1 comprises is located on an axis x'1 parallel to axis x1.

These two projecting surfaces SB1, SC1 belonging to first pixel PX1, have a length L1 parallel to addressing electrode X1, which preferably (but not necessarily) is greater than half of distance D1 which separates inside edges, respectively 11, 12, of addressing-sustaining electrode Y1 and sustaining-only electrode El belonging to first pair p1.

Second pixel PX2 formed at the crossing of second addressing electrode X2 and first pair p1 is composed in the same manner as first pixel PX1: first addressing-sustaining electrode Y1 is provided with a second projecting surface SB2 aligned on an axis x2 of second addressing electrode X2; sustaining-only electrode E1 also comprises a second projecting surface SC2 arranged along an axis x'2 parallel to axis x2 of addressing electrode X2. Third pixel PX3 at the intersection of third addressing electrode X3 and first pair p1 is formed in a manner similar to that of first and second pixels PX1, PX2: first addressing-sustaining electrode Y1 comprises a third projecting surface SB3 aligned on an axis x3 of third addressing electrode X3; and first sustaining-only electrode E1 also comprises a third projecting surface SC3 aligned on an axis x'3 parallel to third addressing electrode X3.

In the nonlimiting example described, all these projecting surfaces have same length L1, and same width L2 parallel to the sustaining electrodes. On the other hand, two projecting surfaces SB1 to SB3, SC1 to SC3 of the same pixel are at a distance d1 from one another clearly less than distance d2 which separates two consecutive projecting surfaces but belonging to different pixels. Thus, for example, as shown in FIG. 2, distance d1, which in first pixel PX1 separates two projecting surfaces SB1, SC1 parallel to an electrode pair p1, p2, this distance d1 is clearly less than distance d2 which separates first projecting surface SC1 (belonging to first sustaining-only electrode E1 in first pixel PX1) of second projecting surface SB2 which in second pixel PX2 belongs to first addressing-sustaining electrode Y1; and the same holds true for the projecting surfaces of pixels PX2, PX3.

An identical arrangement is made at the level of fourth, fifth, and sixth pixels PX4, PX5, PX6 formed at the intersections of second pair p2 with first, second, and third addressing electrodes X1, X2, X3; these pixels PX4, PX5, PX6 comprising, in a same manner, projecting surfaces referenced SB1 to SB3 and SC1 to SC3 which, as in the examples above, are aligned on axes x1, x'1, x2, x'2, x3, x'3.

It can be observed that in the configuration of the invention, in the same pixel, projecting parts SB! to SB3, SC1 to SC3 belonging to addressing and sustaining electrode Y1, Y2, and sustaining-only electrode E1, E2 are not face to face as in the prior art, but offset, so that in the pixels, these projecting surfaces make it possible to form a channel C (delimited in FIG. 2 in thicker lines) having a relatively small width, formed for at least one part by distance d1, which can correspond, for example, to the distance which in the prior art separates the ends opposite the projecting surfaces. But in the prior art, the length of these projecting surfaces opposite is relatively small, and it is much larger in the configuration of the invention where the average length of channel C corresponds approximately to the addition of two widths L2 and a length L1 of projecting surfaces, plus a distance d1 between two projecting surfaces in the same pixel. This has the effect of increasing the length of the surfaces opposite, and, as a result, improving the operation particularly because the necessary potential difference between the two electrodes of a sustaining electrode pair p1, p2 is decreased.

Further, in the configuration of the invention, with same pitch P as in the prior art between addressing electrodes X1, X2, X3 or column electrodes, because the two projecting surfaces of the same pixel are offset, it is obtained between two adjacent pixels that the two closest projecting parts belong one to an addressing and sustaining electrode Y1, Y2, and the other to a sustaining-only electrode E1, E2, so that these two closest projecting parts between two consecutive pixels are at opposite polarities; further taking into account that these two projecting parts brought to opposite polarities are located at a distance d2 from one another less than the distance which in the prior art separates the projecting parts of two adjacent pixels, these two projecting parts each have a tendency to repel strongly the charges which would have a tendency to be deposited close to these projecting surfaces.

Figure 1:
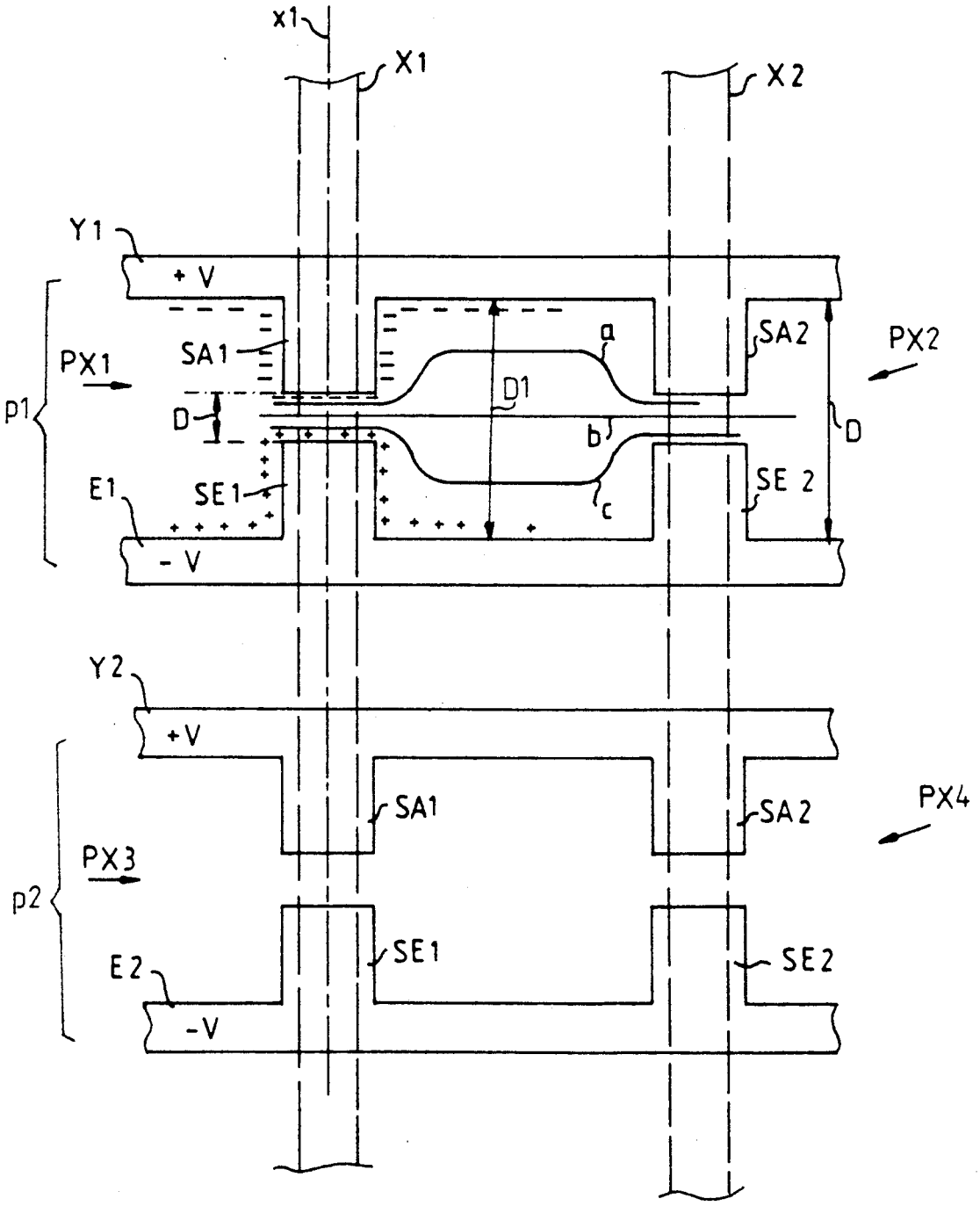
FIG. 1 PRIOR ART
FIG. 1, already described, shows the electrodes of a plasma panel of the prior art.

This is illustrated in FIG. 2 at the level of fifth pixel PX5, and between the latter and sixth pixel PX6. It is observed that for a potential difference, applied between addressing-sustaining electrodes Y1, Y2 and maintenance-only electrodes E1, E2, equal to what is applied in the prior art shown in FIG. 1, equipotential lines a, b, c, which are produced between these electrodes in the configuration of the invention, exist in channel C with as high a concentration as between the surfaces with regard to the case of the prior art (shown in FIG. 1); and exist with a much higher concentration than in the case of the prior art in the part located between two projecting parts of two adjacent pixels, from which it results that a much greater force than in the prior art is applied to the charges to prevent them from migrating from one pixel to an adjacent pixel. This, of course, is subject to this force remaining lower than that which is sufficient to produce a parasitic discharge between these two adjacent pixels.

Thus, assuming that fifth pixel PX5 is in state 1, potential V applied between addressing-sustaining electrodes Y1, Y2 and sustaining-only electrodes E1, E2 causes a discharge in fifth pixel PX5, between the opposing surfaces which border channel C; these surfaces being delimited in FIG. 2 by thicker lines referenced 30, 31, lines which constitute the edges of channel C. During this discharge, negative charges—are fixed on first edge 30 of channel C which is at positive polarity because it belongs to an addressing-sustaining electrode Y1, Y2, and positive charges + are accumulated on second edge 31 which is at negative polarity because it belongs to a sustaining-only electrode E1, E2. On the side of sixth pixel PX6, third projecting surface SB3, which belongs to second addressing-sustaining electrode Y2, because of its proximity and its position, tends to repel positive charges +which would have a tendency to migrate toward sixth pixel PX6; in the same manner, first projecting surface SC1, which in fourth pixel PX4 belongs to second sustaining-only electrode E2, repels negative charges − which would have a tendency to migrate toward fourth pixel PX4.

This illustrates the advantageous effect on the invention on the containment of discharges.

Another particularly important effect which results from the application of the invention is that addressing electrodes or column electrodes X1, X2, X3 no longer are placed between an observer and the most intense part of the light source of a pixel, as in the prior art, but only in front of a relatively low fraction of this most intense part which is represented in the invention by the unit of channel C.

It should be noted further that the offset of the projecting parts in the panel of the invention makes it possible to bring close together the two electrodes of same pair pl, p2, which optionally makes it possible, for the same panel dimensions, to place more sustaining electrode pairs and, as a result, to increase the resolution.

It is noted that in the prior art, the main axis along which the discharges are made is approximately parallel to the addressing electrodes or column electrodes, while in the plasma panel of the invention, this main axis referenced XP is made approximately with an angle of 45° relative to addressing electrodes or column electrodes X1, X2, X3, which tends to modify the shape of the pixels in the panel of the invention relative to a pixel of the prior art, and as a result to degrade slightly the alignment of the pixels in the direction of the columns. This defect is, however, quite minor in view of the significance of the improvements obtained in the panel of the invention.

Figure 3:
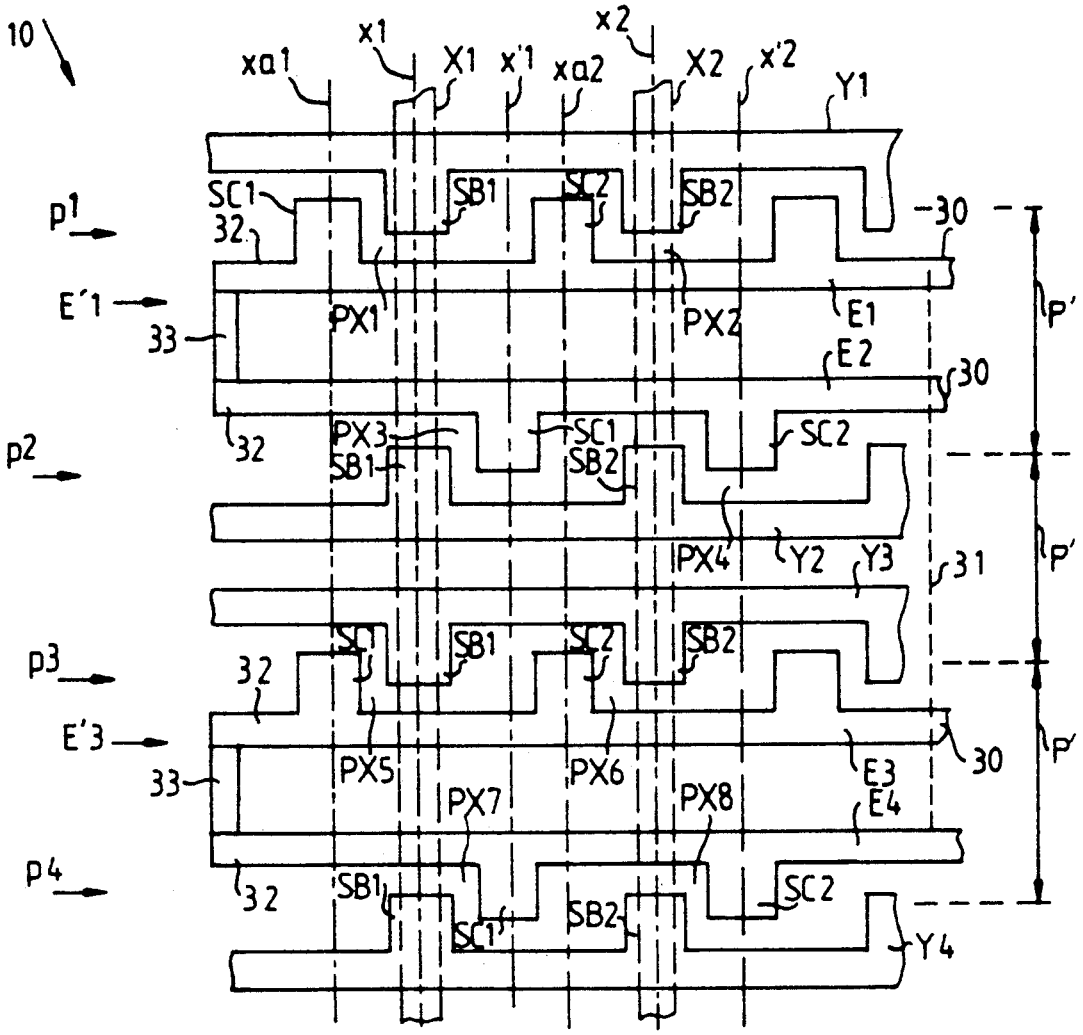
FIG. 3 shows a variant of the embodiment of the invention shown in FIG. 2.

FIG. 3 illustrates an application of the invention in case plasma panel 10 comprises sustaining electrode pairs p1, p2, p3, p4 formed by an arrangement in which two sustaining-only electrodes are followed by two addressing-sustaining electrodes, themselves followed by two sustaining-only electrodes, etc.... To simplify FIG. 3, only two addressing electrodes X1, X2 or column electrodes, crossed with four sustaining electrode pairs p1, p2, p3, p4, have been shown.

Examining the electrodes from the top of the figure to the bottom, there are:

first addressing-sustaining electrode Y1, followed by first sustaining-only electrode E1; these two electrodes forming first electrode pair p1;

after first sustaining-only electrode E1, there is a second sustaining-only electrode E2 which is followed by a second addressing-sustaining electrode Y2, these two latter electrodes forming second sustaining electrode pair p2;

next, there is a third addressing-sustaining electrode Y3 which is followed by a third sustaining-only electrode E3 in order to constitute a third pair p3;

then a fourth sustaining-only electrode E4 is followed by a fourth addressing-sustaining electrode Y4 which two latter electrodes form a fourth pair p4.

As has been discussed previously, there is, in this arrangement, a sequence of two electrodes of the, addressing-sustaining type followed by two sustaining-only type electrodes, and so on with the two electrodes of the same type being used to form two different, but consecutive, electrode pairs. One of the advantages of such a sustaining electrode arrangement is a decrease or elimination of the capacitances between electrodes, and also the possibility to obtain protection between the cutoffs which can occur in the continuity of sustaining-only electrodes E1 to E4. Actually, all sustaining-only electrodes E1 to E4 are brought at the same moment to the same potentials, and, as a result, they can be connected to one another electrically on the side not only of their first end 30 by a connection 31 (shown in dotted lines) but also on the side of their second end 32, as shown in FIG. 3 where they are connected by a linking conductor 33. Because two consecutive sustaining-only electrodes are connected to one another on the side of their two ends, 30, 32, a part of one of these two electrodes, located after a cutoff (not shown), would be fed on the side of second end 32. It should be further noted that these two electrodes can be assembled in a single electrode E'1, E'3 by filling the space between these two electrodes with conductive material.

In this configuration with two successive sustaining electrodes of the same type, a migration of the charges in the direction of the addressing electrodes or column electrodes X1, X2 can occur; i.e., the discharge at the level of a pixel PX1 to PX8 can project into the zone of an adjacent pixel being considered in the direction of addressing electrodes X1, X2. Pixels PX1 to PX8 each are formed approximately at the intersection of an addressing electrode X1, X2 with a sustaining electrode pair p1 to p4. These pairs p1 to p4 are arranged according to a pitch P' which acts on the image resolution, and the fact of arranging projecting parts SB1, SB2 and SC1, SC2 of the same pixel in an offset manner, according to the principle of the invention, makes it possible to increase the distance which separates two consecutive pixels in the direction of addressing electrodes X1, X2, without losing any image resolution.

For this purpose, projecting parts SB1, SB2 which belong to addressing-sustaining electrodes Y1 to Y4 are aligned on axes x1, x2 of addressing electrodes X1, X2. For projecting parts SC1, SC2 which belong to two successive sustaining-only electrodes E1 to E4, these projecting parts, belonging to the first of these two electrodes, are arranged so as to be offset on a first side of addressing electrodes X1, X2, and the projecting parts belonging to the following electrode are arranged on the opposite side. Thus, in the nonlimiting example shown in FIG. 3, projecting surfaces SB1, SB2 of addressing-sustaining electrodes Y1 to Y4 are aligned on axes x1, x2 of addressing electrodes X1, X2. First and second sustaining-only electrodes E1, E2 constitute a group E'1 of two successive sustaining electrodes or constitute a single electrode as was said above, and projecting surfaces SC1, SC2, which belong to first sustaining-only electrode E1 are arranged respectively aligned on axes xa1, xa2, located on one side of addressing electrodes X1, X2, while projecting surfaces SC1, SC2, which belong to second sustaining-only electrode E2 are arranged on an opposite side, namely aligned on axes x'1, x'2, as in the example of FIG. 2. Third and fourth sustaining-only electrodes E3, E4 form another group E'3 of two consecutive sustaining-only electrodes, and projecting surfaces SC1, SC2 of third sustaining-only electrode E3 are arranged in the same manner as in the case of first sustaining-only electrode E1, while projecting surfaces SC1, SC2 of fourth sustaining-only electrode E4 are arranged in the same manner as the projecting surfaces of second sustaining-only electrode E2.

From this arrangement, a zigzag placing of pixels PX1 to PX8 results, which tends to increase the distance between the pixels in the direction of the addressing electrodes, which makes it possible to obtain a better containment of the discharges without increasing pitch P' between pairs p1 to p4.

Figure 4:
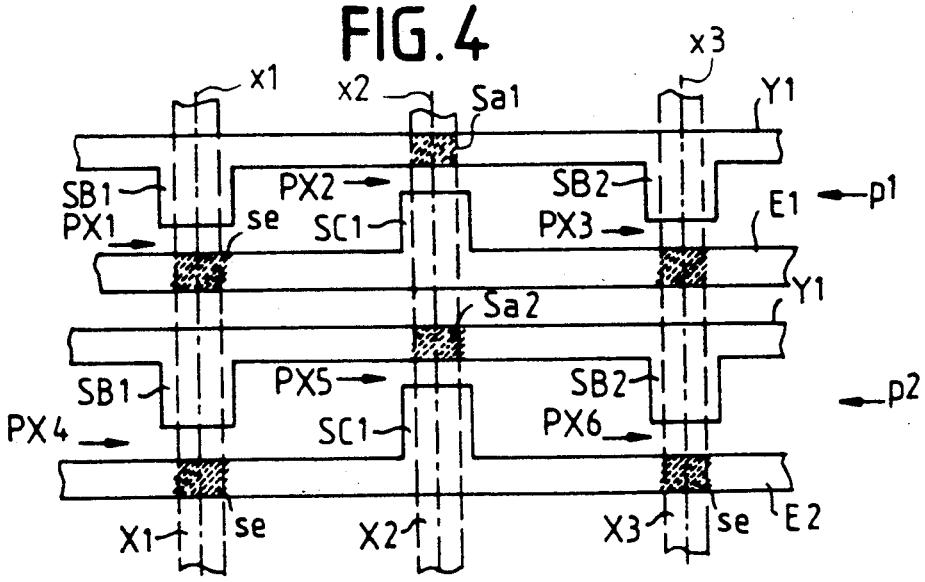
FIG. 4 shows a second embodiment of the invention.

FIG. 4 diagrammatically shows another embodiment of plasma panel 10 of the invention, an embodiment which makes possible a better containment of the discharges as in the preceding examples and which further makes it possible to simplify the production of the electrode network.

In this embodiment, each pixel comprises a single projecting surface which, for a given pixel, belongs to one of the electrodes of the sustaining electrode pair, and which, for a pixel along the same sustaining electrode pair, belongs to the other sustaining electrode.

To simplify the figure and for greater clarity of the latter, only three addressing electrodes X1, X2, X3 crossed with only two sustaining electrode pairs p1, p2 are shown, from which the formation of only six pixels PX1 to PX6 results. First pair p1 is formed by first addressing-maintenance electrode Y1 and by first maintenance electrode E1, and second pair p2 is formed by second addressing-sustaining electrode Y2 and by second sustaining-only electrode E2.

First pixel PX1, formed in the crossing of first addressing electrode X1 and first pair p1, comprises a single projecting part SB1 which belongs to addressing-sustaining electrode Y1. As a result, the sustaining discharge in first pixel PX1 occurs between this projecting surface SB1 and directly sustaining-only electrode E1, more precisely by a part Se of the latter symbolized by the hatching in FIG. 4, part which is located opposite projecting surface SB1.

For second pixel PX2, there also is a single projecting part SC1, but which this time belongs to sustaining-only electrode E1, and third pixel PX3 is constituted like first pixel PX1. With this arrangement, and even though a single projecting surface exists per pixel, the general principle of the invention is found according to which of the two closest projecting parts between two consecutive pixels, along the same sustaining electrode pair, one belongs to an addressing-sustaining electrode and the other to a sustaining-only electrode, which makes it possible to obtain the technical effects already described in reference to FIG. 2.

The absence of projecting surface belonging to first addressing-sustaining electrode Y1 in second pixel PX2 makes the sustaining discharge occur between first addressing-sustaining electrode Y1 itself and projecting part SC1 which belongs to first sustaining-only electrode E1.

For third pixel PX3, the same structure as for first pixel PX1 is found, namely that first addressing-sustaining electrode Y1 is provided with a projecting surface SB3 aligned on axis x3 of third addressing electrode X3, first sustaining-only electrode E1 not comprising a projecting surface at the level of this third pixel PX3. Pixels PX4, PX5, PX6 can be formed respectively in the same manner as first, second, and third pixels PX1, PX2, and PX3.

Addressing of the pixels, can be performed in the same manner as in the case of the preceding examples for the pixels whose single projecting surface belongs to an addressing-maintenance electrode Y1, Y2, as is the case of pixels PX1, PX3, PX4, PX6. On the other hand, for the pixels such as pixels PX2, PX5, whose single projecting surface belongs to sustaining-only electrodes E1, E2, the addressing can require a higher addressing voltage for these pixels than for the others, because for these pixels, addressing electrode Y1, Y2 exhibits, opposite addressing electrode X2, a small surface Sa1, Sa2 because it does not include the surface supplied by the projecting surfaces. But, this addressing voltage difference can be made up, for example, since it is standard to do it in the case it is desired to compensate for a disparity between two cells. This disparity is due, for example, to a difference of nature of luminophores in the case of a color type plasma panel.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A coplanar sustaining plasma panel, comprising:

addressing electrodes;

sustaining electrodes arranged in pairs and crossing said addressing electrodes, each sustaining electrode pair being formed by an addressing-sustaining electrode and a sustaining-only electrode;

a pixel formed approximately at each crossing of an addressing electrode with one of said sustaining electrode pairs, each of said electrodes of said sustaining electrode pairs comprising projecting surface, wherein said addressing electrodes cross said sustaining electrode pairs above said projecting surfaces belonging to said addressing-sustaining electrodes, and said projecting surfaces are oriented facing each other and offset relative to one another along different axes such that adjacent projecting surfaces alternately belong to an addressing-sustaining electrode and a sustaining-only electrode.

2. A coplanar sustaining plasma panel comprising:

addressing electrodes crossing sustaining electrodes arranged in pairs, each sustaining electrode pair being formed by an addressing-sustaining electrode and a sustaining-only electrode, wherein said address-sustaining electrodes and said sustaining-only electrodes are arranged in a sequence of two address-sustaining electrodes followed by two-sustaining-only electrodes, such that two consecutive sustaining-only electrodes form two consecutive sustaining electrode pairs and such that said two consecutive sustaining-only electrodes optionally constitute a single electrode common to said two consecutive sustaining electrode pairs;

a pixel formed approximately at each crossing of an addressing electrode with one of said sustaining electrode pairs, each of said electrodes of said sustaining electrode pairs comprising projecting surfaces, wherein said projecting surfaces of said addressing-sustaining electrodes are arranged approximately aligned on axes of said addressing electrodes, and said projecting surfaces of said two consecutive sustaining-only electrodes which form said two consecutive sustaining electrode pairs are arranged, for a first of said two consecutive sustaining-only electrodes on a first side of said axes of said addressing electrodes, and for a second of said two consecutive sustaining-only electrodes, on a side opposite to said first side of said axes.

* * * * *